US006871849B2

(12) United States Patent
Kerpe et al.

(10) Patent No.: US 6,871,849 B2
(45) Date of Patent: Mar. 29, 2005

(54) DELIVERY FOR A SHEET-PROCESSING MACHINE, ESPECIALLY A ROTARY PRINTING MACHINE

(75) Inventors: Sven Kerpe, Eggenstein-Leopoldshafen (DE); Frank Gunschera, Nussloch (DE); Ralf Wadlinger, Heidelberg (DE); Manfred Koch, Sandhausen (DE)

(73) Assignee: Heidelberger Druckcmaschinen AG, Heidelberg (DE)

( * ) Notice: Subject to any disclaimer, the term of this patent is extended or adjusted under 35 U.S.C. 154(b) by 41 days.

(21) Appl. No.: 09/817,968

(22) Filed: Mar. 27, 2001

(65) Prior Publication Data

US 2001/0026042 A1 Oct. 4, 2001

(30) Foreign Application Priority Data

Mar. 27, 2000 (DE) ..... 100 14 590
Jan. 25, 2001 (DE) ..... 101 03 235

(51) Int. Cl.[7] ..... B65H 29/68

(52) U.S. Cl. ..... 271/182; 271/183; 271/207; 271/264; 271/69

(58) Field of Search ..... 271/69, 182, 183, 271/207, 264

(56) References Cited

U.S. PATENT DOCUMENTS 3,965,767 A * 6/1976 Rinio ..... 254/371
4,693,462 A * 9/1987 Pollich ..... 271/183
6,360,739 B1 * 3/2002 Rand et al. ..... 128/200.14

FOREIGN PATENT DOCUMENTS

DE 26 27 812 A1 12/1977
DE 197 09 083 C1 10/1998
DE 198 35 003 A1 2/2000

* cited by examiner

*Primary Examiner*—Eileen D. Lillis
(74) *Attorney, Agent, or Firm*—Laurence A. Greenberg; Werner H. Stemer; Ralph E. Locher

(57) ABSTRACT

A delivery includes sheet brakes and sheet supports constructed of modules including respectively identical carrier modules and braking modules with operationally revolving braking elements, the braking modules being selectively connectable to the carrier modules, and support modules selectively connectable to the carrier modules.

24 Claims, 12 Drawing Sheets

DELIVERY FOR A SHEET-PROCESSING MACHINE, ESPECIALLY A ROTARY PRINTING MACHINE

BACKGROUND OF THE INVENTION

Field of the Invention

The invention relates to a delivery for a sheet-processing machine, especially a rotary printing machine, and to a sheet-processing machine equipped with the delivery, especially a rotary printing machine.

In the delivery of a sheet-processing machine, such as especially a rotary printing machine, there is often the necessity to arrange sheet supports between sheet brakes, in order to feed the sheets to a stack without smearing. In this case, during a change from one print job to another, a changeover with regard to the number and placing of the sheet brakes and sheet supports is generally necessary.

In order to reduce the changeover effort which arises in this case, the published German Patent Document DE 198 35 003 A1 proposes to replace a braking element through which a vacuum acts in a sheet brake, for a supporting element through which the vacuum does not act, in order to change a sheet brake into a sheet support. However, this requires the braking element and the supporting element to be compatible, with one and the same geometry. There is therefore a very small amount of freedom for the configuration of the sheet supports. In addition, it may be necessary to adapt the total number of sheet brakes and sheet supports to different requirements of different print jobs.

SUMMARY OF THE INVENTION

It is accordingly an object of the invention to provide a delivery for a sheet-processing machine wherein the effort necessary for changing the delivery when changing a job in the sheet-processing machine is virtually eliminated beyond the extent which has already been achieved in the prior art presented hereinbefore.

With the foregoing and other objects in view, there is provided, in accordance with one aspect of the invention, a delivery comprising sheet brakes and sheet supports constructed of modules including respectively identical carrier modules and braking modules with operationally revolving braking elements, the braking modules being selectively connectable to the carrier modules, and support modules selectively connectable to the carrier modules.

In accordance with another feature of the invention, the delivery includes a guide common to the carrier modules.

In accordance with a further feature of the invention, the delivery includes servodrives for moving the carrier modules along the guide.

In accordance with an added feature of the invention, the delivery includes a drive shaft common to the sheet brakes.

In accordance with an additional feature of the invention, a respective sheet brake comprises a gear mechanism for operatively connecting the braking element to the drive shaft, the gear mechanism being constructed so that it can slide in longitudinal direction of the drive shaft.

In accordance with yet another feature of the invention, the gear mechanism is integrated into the braking module.

In accordance with yet a further feature of the invention, the delivery includes a coupling for disengaging the operative connection between the drive shaft and the braking element.

In accordance with yet an added feature of the invention, the coupling is constructed as a claw coupling, and has axially sprung claws.

In accordance with yet an additional feature of the invention, the gear mechanism is integrated into the carrier module.

In accordance with still another feature of the invention, the delivery includes a guide common to the carrier modules, one of the carrier modules being separably composed of a basic module movable along the common guide and a gear mechanism module comprising the gear mechanism, one module of the braking modules and the support modules being selectively detachably connectable to the gear mechanism module.

In accordance with still a further feature of the invention, the delivery includes lockable plug-in connections for assembling respective modules for forming one of the sheet brakes and the sheet supports.

In accordance with still an added feature of the invention, the delivery includes a first suction duct provided in the braking module, and a second suction duct provided in a module for carrying the braking module, the second suction duct being connectable to a suction line, and being closable, the second suction duct communicating with the first suction duct, in a completed state of the sheet brake.

In accordance with another feature of the invention, the delivery includes a suction line detachably connected to the suction duct and to a machine-side blind plug, to which the suction line is pluggable after the connection thereof to the suction duct has been detached.

In accordance with a further feature of the invention, the delivery includes a latch bringable into and out of engagement with the drive shaft and, when engaged therewith, securing it against axial displacement, an end of the drive shaft being exposable when the latch is disengaged from the drive shaft.

In accordance with an added feature of the invention, one of the support modules comprises a tail wheel device.

In accordance with an additional feature of the invention, at least one of the supporting modules serves for applying blast air locally to an underside of a respective sheet.

In accordance with another aspect of the invention, there is provided a sheet-processing machine having a delivery comprising sheet brakes and sheet supports constructed of modules including respectively identical carrier modules and braking modules with operationally revolving braking elements, the braking modules being selectively connectable to the carrier modules, and support modules selectively connectable to the carrier modules.

In accordance with a concomitant aspect of the invention, there is provided a rotary printing machine having a delivery comprising sheet brakes and sheet supports constructed of modules including respectively identical carrier modules and braking modules with operationally revolving braking elements, the braking modules being selectively connectable to the carrier modules, and support modules selectively connectable to the carrier modules.

In order to achieve the objective of the invention, the delivery is thus equipped with sheet brakes and sheet supports which are constructed as modules comprising a carrier model, which is identical in each case, and braking modules and support modules which can optionally be connected to the carrier modules.

This provides, in particular, the possibility of making a sheet brake or a sheet support or both ineffective at the same time, without necessitating complete disassembly thereof, because the associated carrier module or modules can be left in the delivery without requiring a braking module or a supporting module to be connected thereto.

Furthermore, more freedom for the configuration of the sheet supports is provided.

Other features which are considered as characteristic for the invention are set forth in the appended claims.

Although the invention is illustrated and described herein as embodied in a delivery for a sheet-processing machine, especially a rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
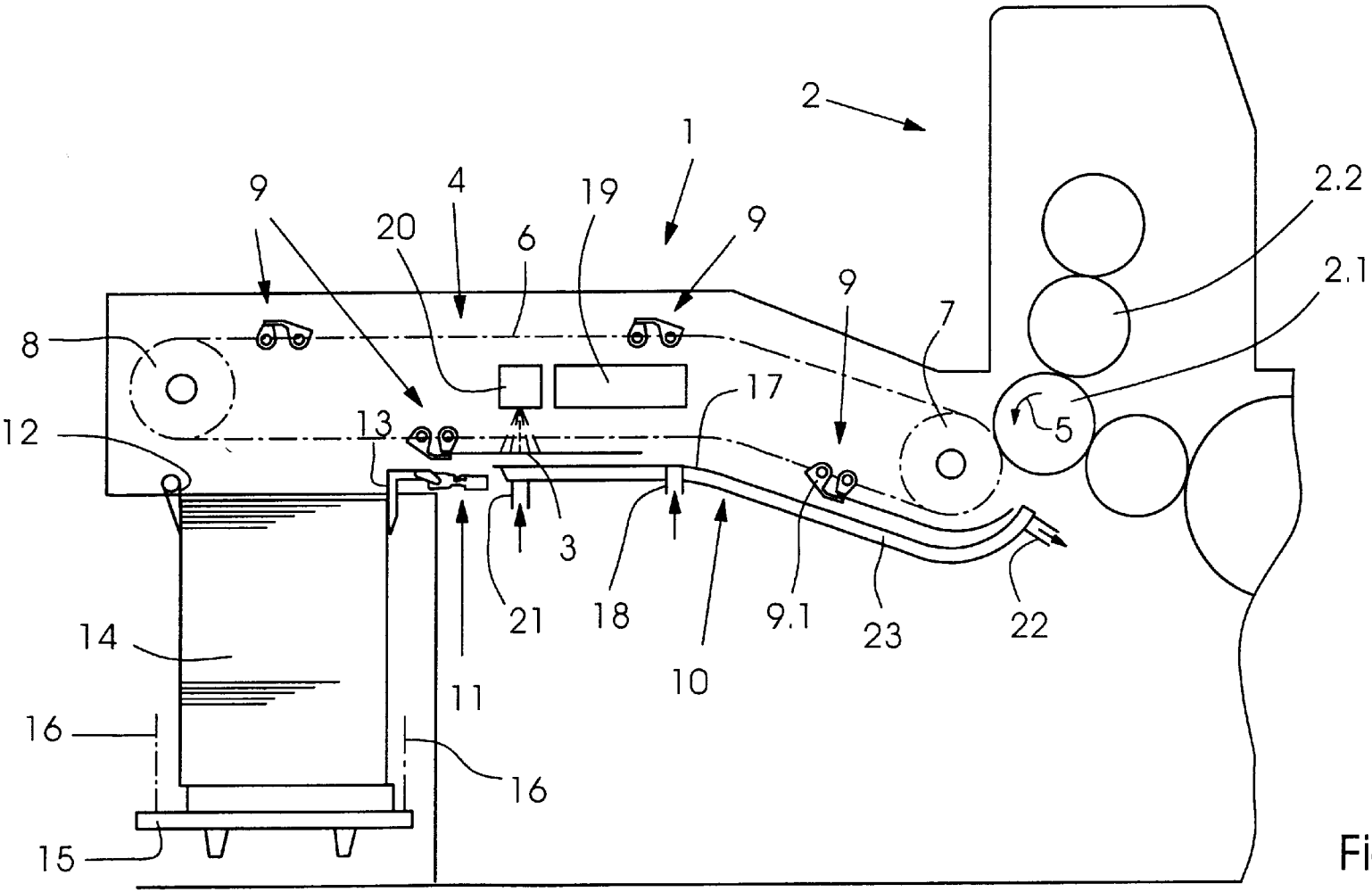
FIG. 1 is a fragmentary diagrammatic side elevational view of a sheet-processing rotary printing machine, including the delivery thereof.

Referring now to the drawings and, first, particularly to FIG. 1 thereof, there is shown therein a section of a sheet-processing rotary printing machine including a delivery 1 following a last processing station. Such a processing station may be a printing unit or a post-treatment unit, such as a varnishing unit. In the example at hand, the last processing station is a printing unit 2 operating with the offset process and having an impression cylinder 2.1. The latter carries a respective sheet 3 in a processing direction indicated by a direction-of-rotation arrow 5, through a printing nip between the impression cylinder 2.1 and a blanket cylinder 2.2 co-operating therewith, and subsequently transfers the sheet 3 to a chain conveyor 4 while opening grippers which are arranged on the impression cylinder 2.1 in order to grip the sheet 3 at a gripper edge at the leading end of the sheet. The chain conveyor 4 includes two conveyor chains 6, one of which, respectively, revolving along a respective side wall of the delivery 1 when operating. A respective conveyor chain 6, in each case, loops around one of two synchronously driven drive sprocket wheels 7, which have axes of rotation aligned with one another, and in the example at hand is guided over a deflecting sprocket wheel 8 located downline in the processing direction of the drive sprockets 7. Between the two conveyor chains 6 there extend gripper systems 9 carried by the chains 6 and having grippers 9.1, which pass through gaps between grippers arranged on the impression cylinder 2.1 and, in so doing, accept a respective sheet 3 by gripping the aforementioned gripper edge at the leading end of the sheet 3 directly before the grippers arranged on the impression cylinder 2.1 are opened, transport the sheet over a sheet guide device 10 to a braking and supporting device 11 and open there in order to transfer the sheet 3, especially to sheet brakes. The latter impart to the sheets a deposition speed which is reduced with respect to the processing speed and, after reaching the deposition speed, in turn, release the sheet, so that a respective sheet 3 which has now been retarded finally encounters leading-edge stops 12 and, being aligned on the latter and on opposite trailing-edge stops 13, forms a stack or pile 14 together with preceding and/or following sheets 3, it being possible for the pile 14 to be lowered by a lifting mechanism to the extent to which the pile 14 grows with added sheets 3. Of the lifting mechanism, FIG. 1 shows only a platform 15 carrying the pile 14 and lifting chains 16 shown in phantom which carry the platform.

The conveyor chains 6 are guided along the paths thereof between the drive sprockets 7, on the one hand, and the deflection sprockets 8, on the other hand, by chain guide rails, which therefore determine the chain paths of the chain strands or runs. In the example at hand, the sheets 3 are transported by the lower chain strand in FIG. 1. The section of the chain path through which the latter runs is followed by a sheet guide surface 17 which faces the section and is constructed on the sheet guide device 10. Between the sheet guide surface 17 and the sheet 3 guided thereover, respectively, a supporting air cushion is preferably formed during operation. For this purpose, the sheet guide device 10 is equipped with blast or blown air nozzles which open into the sheet guide surface 17 and of which FIG. 1 reproduces only one as representative of all thereof, and in a symbolic representation in the form of the nozzle 18.

In order to prevent mutual sticking or cohesion of the printed sheets 3 in the pile 14, a dryer 19 and a powdering device 20 are provided on the path of the sheets 3 from the drive sprockets 7 to the sheet brake 11.

In order to avoid excessive heating of the sheet guide surface 17 by the dryer 19, a coolant circuit is integrated into the sheet guide device 10, which is indicated symbolically in FIG. 1 by an inlet nozzle 21 and an outlet nozzle 22 on a coolant trough 23 associated with the sheet guide surface 17.

Figure 2:
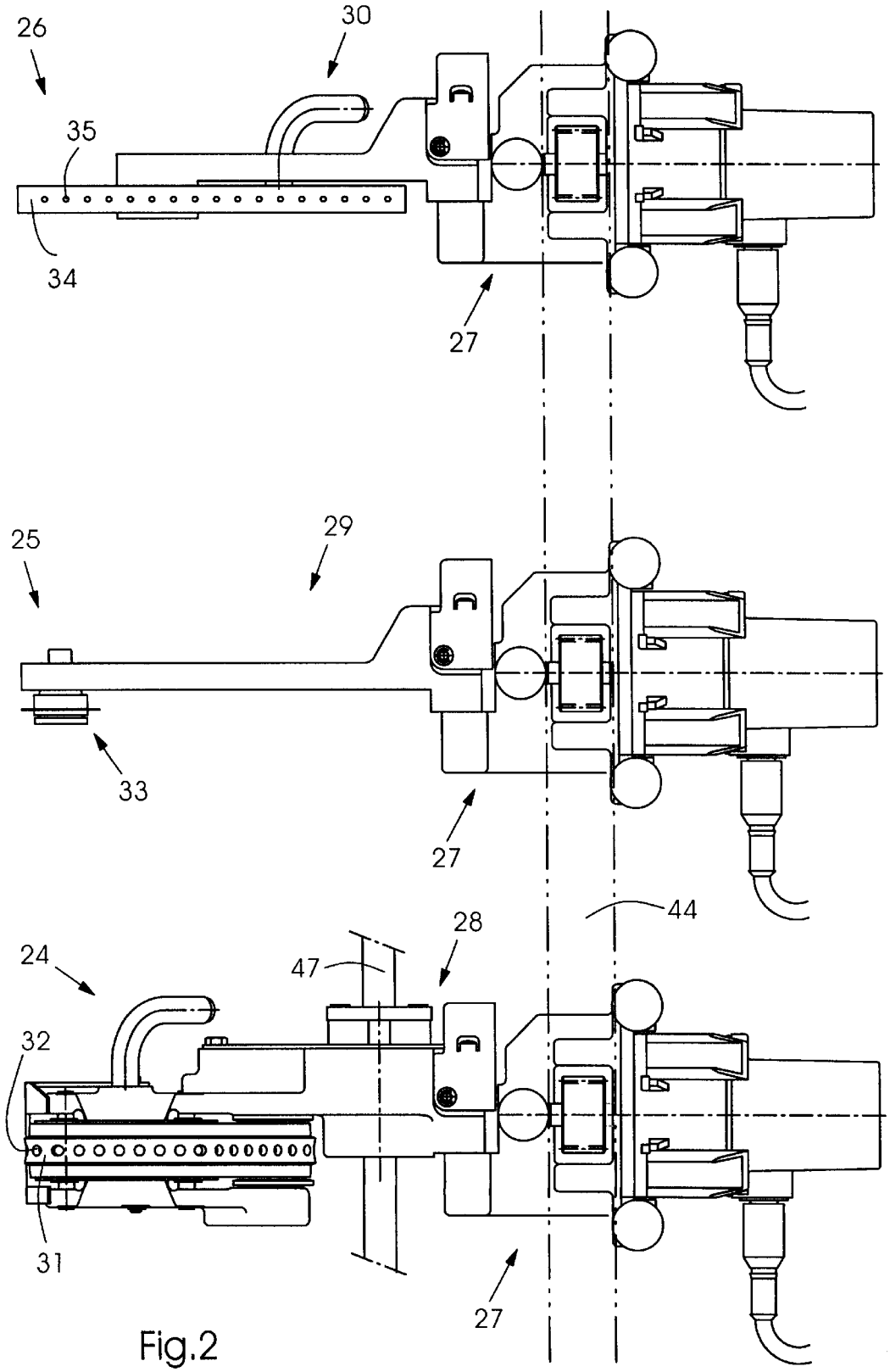
FIG. 2 is a detail, in plan view, of a first embodiment of a braking and supporting device including sheet brakes and sheet supports, in accordance with the invention.

The plan view shown in FIG. 2 of a detail of a first embodiment of the braking and supporting device 11 includes exemplary embodiments of a sheet brake 24, a mechanical sheet support 25 and a pneumatic sheet support 26. The sheet brake 24 and the sheet supports 25 and 26, respectively, have identical carrier modules 27. Connected to such a carrier module is a braking module 28 in the case of the sheet brake 24, a correspondingly mechanical supporting module 29 in the case of the mechanical sheet support 25, and a correspondingly pneumatic supporting module 30 in the case of the pneumatic sheet support 26.

The braking module 28 includes a braking element which revolves during operation, in the example shown in the form of a circulating brake band 31, which is provided with suction openings 32, and a suction chamber which is not specifically illustrated here but over which the brake band 31 sweeps and can be connected via a nozzle 132 to a vacuum generator. The mechanical supporting module 29 in the case at hand includes a tail wheel arrangement or rowel 33, and the pneumatic supporting module 30 includes a tube 34 which is connected, in a manner not illustrated, to a blower having outer blower openings 35 which act locally on an underside of a respective sheet 3 with blast or blown air, the tube 34 extending in the processing direction, i.e., in the sheet running or travel direction, in the configuration which is presented. Mechanical and pneumatic supporting modules 29 and 30 can be used alternatively or else together.

Figure 6:
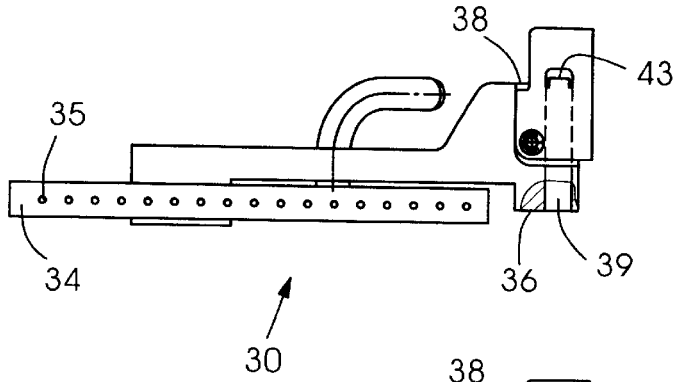
FIG. 6 is a fragmentary plan view of FIG. 2 showing a pneumatic supporting module of the first embodiment.
Figure 5:
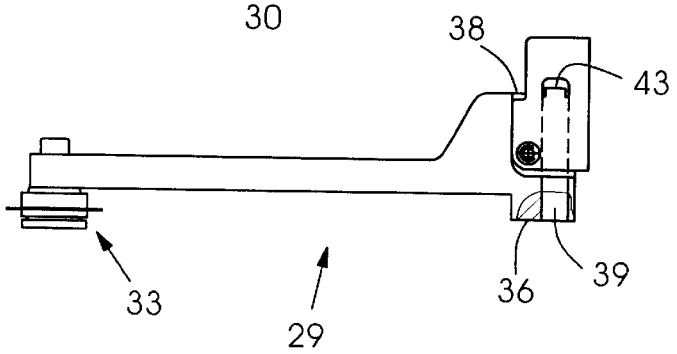
FIG. 5 is a fragmentary plan view of FIG. 2 showing a mechanical supporting module of the first embodiment.
Figure 4:
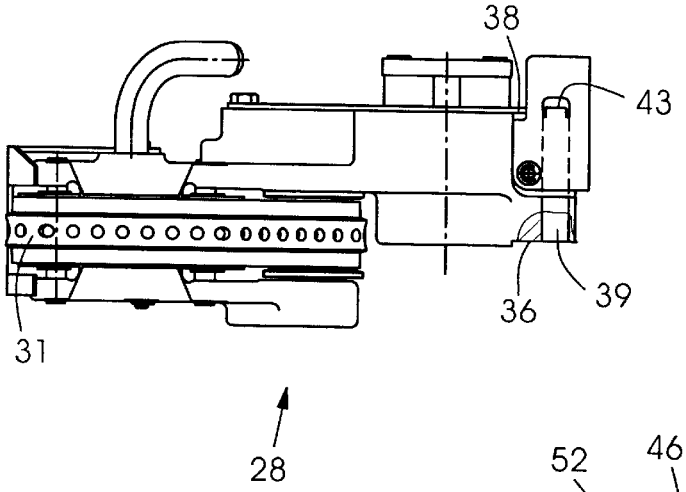
FIG. 4 is a plan view of a braking module, which can be connected to the carrier model of FIG. 3.
Figure 3:
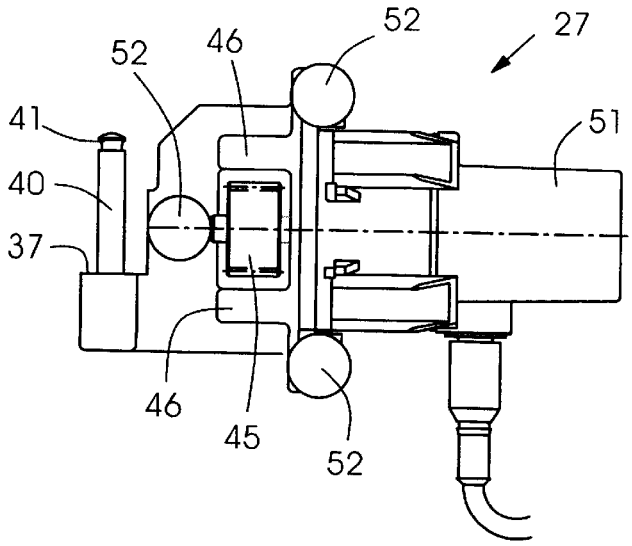
FIG. 3 is a fragmentary plan view of FIG. 2 showing a carrier module of the sheet brakes and sheet supports.
Figure 6A:
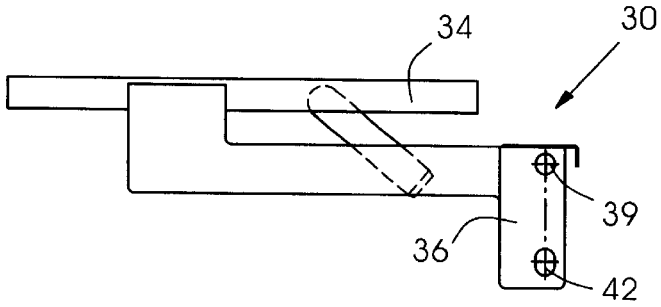
FIG. 6*a* is a side elevational view of FIG. 6, showing the pneumatic supporting module in further detail.
Figure 5A:
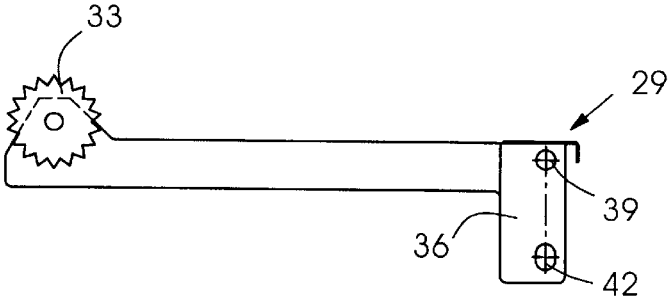
FIG. 5*a* is a side elevational view of FIG. 5, showing the mechanical supporting module in further detail.

The plan view of the carrier module 27 reproduced in FIG. 3, in conjunction with the plan views of FIGS. 4 to 6, which reproduce the braking module 28 and the supporting modules 29 and 30, and in conjunction with the corresponding views of the carrier module 27, the braking module 28 and the supporting modules 29 and 30 according to FIGS. 3*a* to 6*a*, make it clear that the braking module 28 and the supporting modules 29 and 30 can, respectively, be connected to the carrier module 27 in a like manner, to be specific, by a plug-in connection.

This plug-in connection is implemented as follows. Provided on the braking module 28 and on the supporting modules 29 and 30 is a joint face 36, respectively, and provided on the carrier module 27 is a corresponding joint face 37. Opposite the joint faces 36, respectively, is a bounding face 38 which faces away from the joint faces, is parallel thereto and, respectively, at the same distance therefrom. The respective joint face 36 and the respective bounding face 38 are penetrated by an index hole 39 perpendicular thereto. From the joint face 37 constructed on the carrier module 27, there projects an index pin 40. At a distance which corresponds to that of the boundary faces 38 from the joint faces 36, the index pin has a peripheral groove 41. The braking module 28 and the supporting modules 29 and 30 can be plugged onto a respective carrier module 27 while the index pin 40 engages in the respective index hole 39, and a further securing shaft which cannot be seen here but projects from the joint face 37 of the carrier module 27 engages in a slot 42 parallel to the respective index hole.

The braking module 28 and the supporting modules 29 and 30, respectively, have a sprung latching lug 43 which, when the braking and supporting modules 28, 29, 30 are plugged on, engage in the peripheral groove 41 in the index pin 40, with the joint faces 36 and 37 resting on one another.

The carrier modules 27 can be adjusted by servodrives along a common guide, here in the form of a rack 44. Provided for this purpose on the respective carrier module 27 are a servomotor 51 and a pinion 45 which can be driven by the latter and engages in the rack 44. This permits adjustment, especially automated adjustment, of the sheet brakes 24 and the sheet supports 25, 26.

Figure 3A:
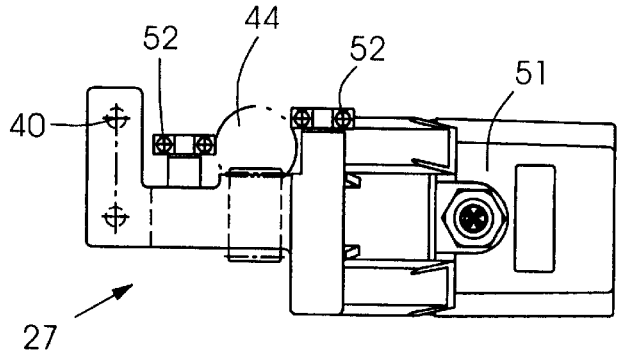
FIG. 3*a* is a side elevational view of FIG. 3, showing further detail of the carrier module of the first embodiment.

The rack 44 has a circular cross section which is flattened by the toothing thereof (note FIG. 3*a*). Formed on the carrier module 27 are flat supporting faces 46 (note FIG. 3), which support the carrier module 27 on the flattened side of the rack 44. In addition, the carrier module 27 includes rollers 52 which can be rotated in relation to axes perpendicular to the supporting faces 46, are supported on the rack 44 on both sides thereof and to some extent are arranged above the horizontal diameter of the cross section of the rack 44.

Figure 4A:
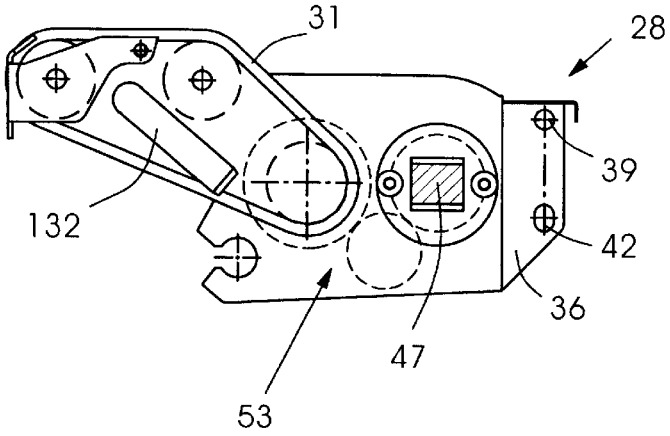
FIG. 4*a* is a side elevational view of FIG. 4, showing the braking module in further detail.

In order to drive a number of sheet brakes 24, a common drive shaft 47 parallel to the rack 44 is provided (note FIGS. 1 and 4*a*).

Figure 7:
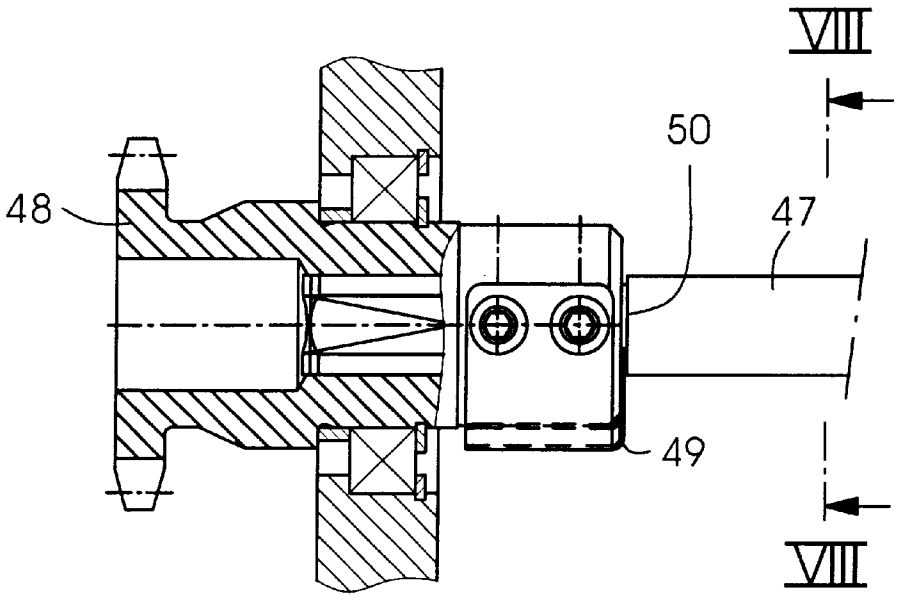
FIG. 7 is a sectional view of one end of a drive shaft for the sheet brake.
Figure 8:
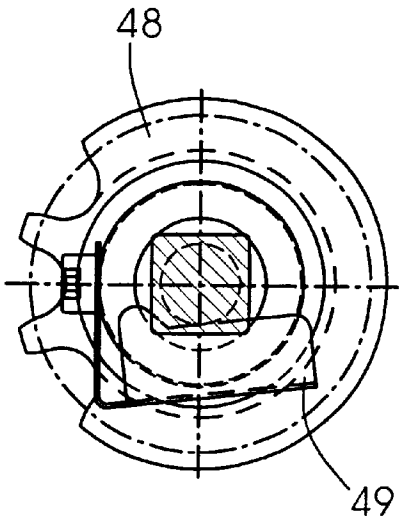
FIG. 8 is a cross-sectional view of FIG. 7 taken along the line VIII—VIII in the direction of the arrows.

As depicted in FIGS. 7 and 8, the drive shaft 47 is inserted with a form fit into a hub of a sprocket 48, which is a constituent part of a chain drive (not illustrated). Fixed to the hub of the sprocket 48 is a latch 49, here in the form of a sheet-metal spring bent over a number of times, which can be brought into and out of engagement with a peripheral groove 50 provided on that end of the drive shaft which is inserted into the hub of the sprocket 48. When engaged, the latch 49 prevents axial displacement of the drive shaft 47. When the latch 49 is released, the drive shaft 47 can be withdrawn from the hub of the sprocket 48. Via the end of the drive shaft 47, which can therefore be exposed, the braking modules 28 can be pulled off the drive shaft 47 or pushed onto the latter.

This provides the option, with a predefined number of carrier modules 27, of forming different numbers of sheet brakes 24 and sheet supports 25, 26, the aforementioned plug-in connection making a further contribution to reducing the changeover effort.

As is apparent from FIGS. 2 and 4*a*, the drive shaft 47 extends through a sheet brake 24 which is provided, respectively, and includes a gear mechanism 53, via which the braking element, provided in the form of the brake band 31, is operatively connected to the drive shaft 47. In order to transmit torque in a formlocking manner, the drive shaft 47 is formed with a square profile and engages in a mating piece which is able to slide with respect to the latter in the longitudinal direction and, in turn, is accommodated formlockingly and radially adjustably in a gearwheel formed as an internal gear on the drive side and belonging to the gear mechanism 53. To this extent, an operative connection is provided between the braking element, here in the form of the brake band 31, and the drive shaft 47, in such a way that a respective sheet brake 24 can be adjusted along the aforementioned common guide, here in the form of the rack 44. With regard to the foregoing, it is noted that a formlocking connection is one which connects two elements together due to the shape of the elements themselves, as opposed to a force-locking connection, which locks the elements together by force external to the elements.

In the case of the exemplary embodiment discussed to this extent of a first embodiment of the braking and supporting device 11, the gear mechanism 53 is integrated into the braking module 28, which can be detached from the carrier module 27.

In a different configuration, which is not reproduced in the drawing here, the braking element, instead of being represented in the form of a brake band belonging to a band brake and wrapping around a drive roller and at least one deflection roller, is represented in the form of a brake roll, as is disclosed by the published German Patent Document DE 28 11 963 C2, for example.

In a particularly advantageous development, a coupling 58 (explained hereinafter) is provided, by which the operative connection between the drive shaft 47 and the braking element, in the case of the second embodiment, explained hereinbelow, in the form of a brake band 131, can be disengaged. Using a coupling provided in this way and, as explained hereinbefore, corresponding plug-in connections, configurations of a second embodiment of the braking and supporting device 11 are obtained which make it possible to dispense with pulling off a module from the common drive shaft 47, as explained in conjunction with the first embodiment, when a braking module is to be replaced by a supporting module.

Figure 9:
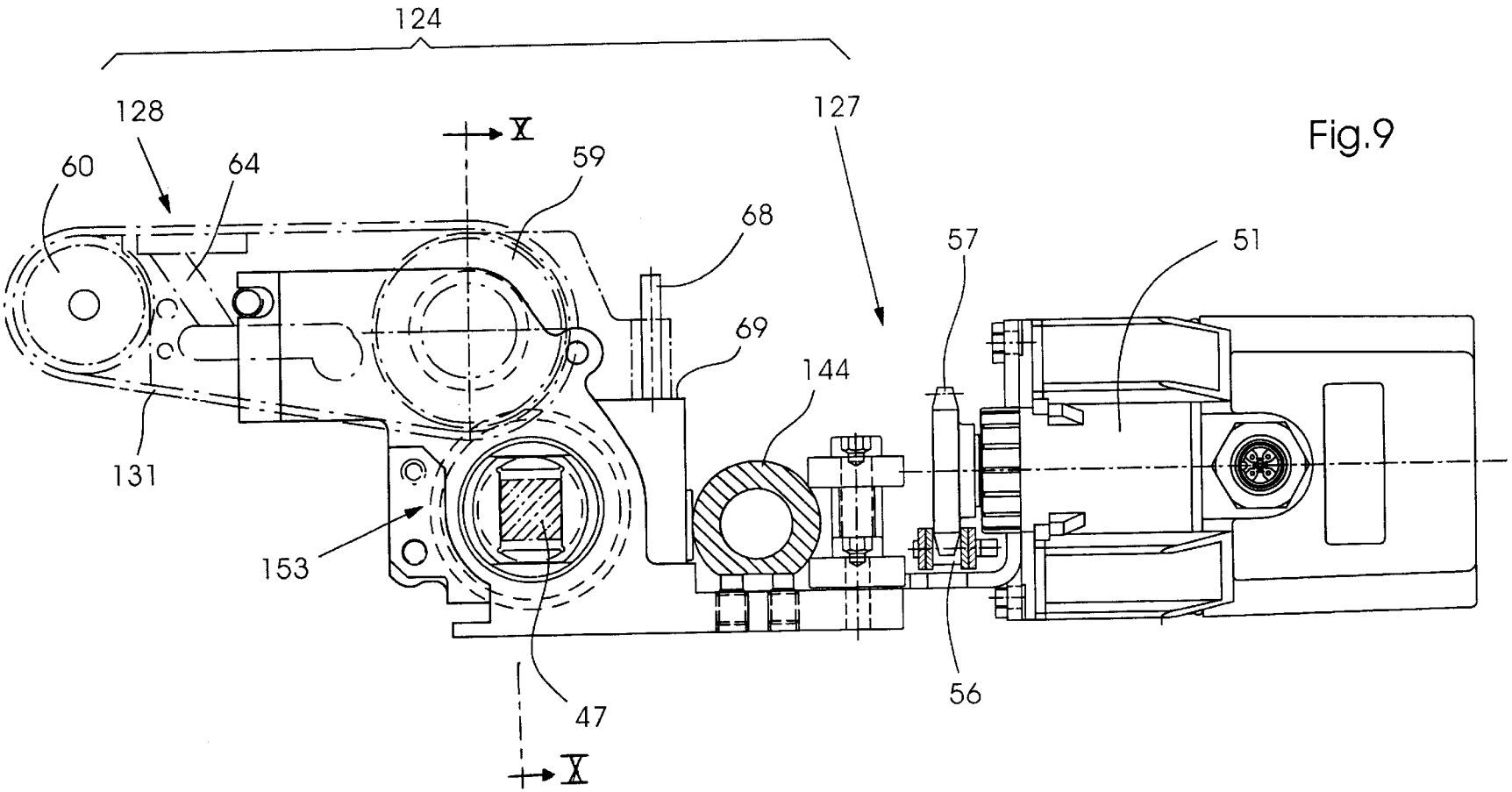
FIG. 9 is a side elevational view of a carrier module according to a second embodiment of the braking and supporting device, together with a braking module shown in phantom.
Figure 10:
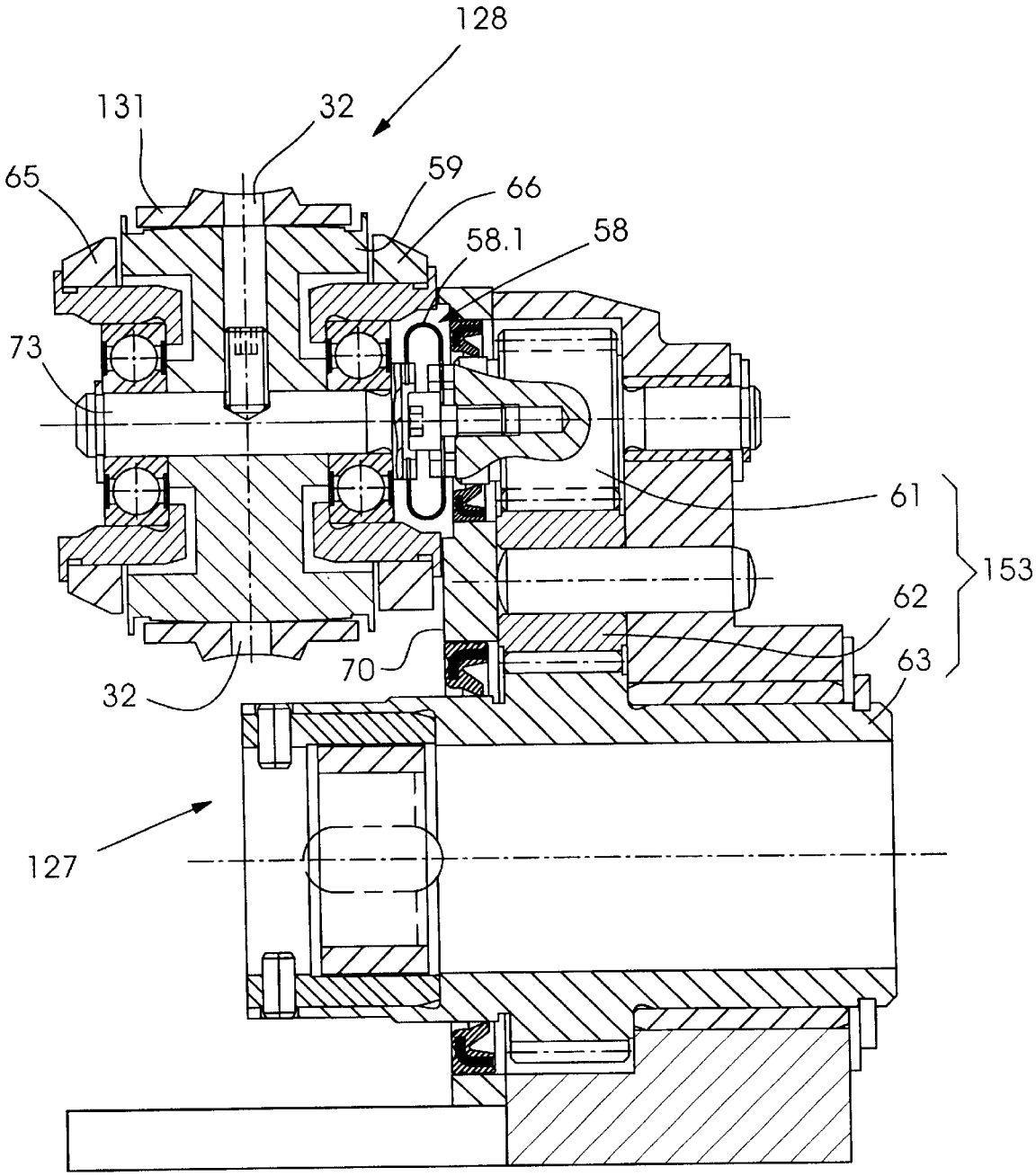
FIG. 10 is a cross-sectional view of FIG. 9 taken along the line X—X in the direction of the arrows.
Figure 11:
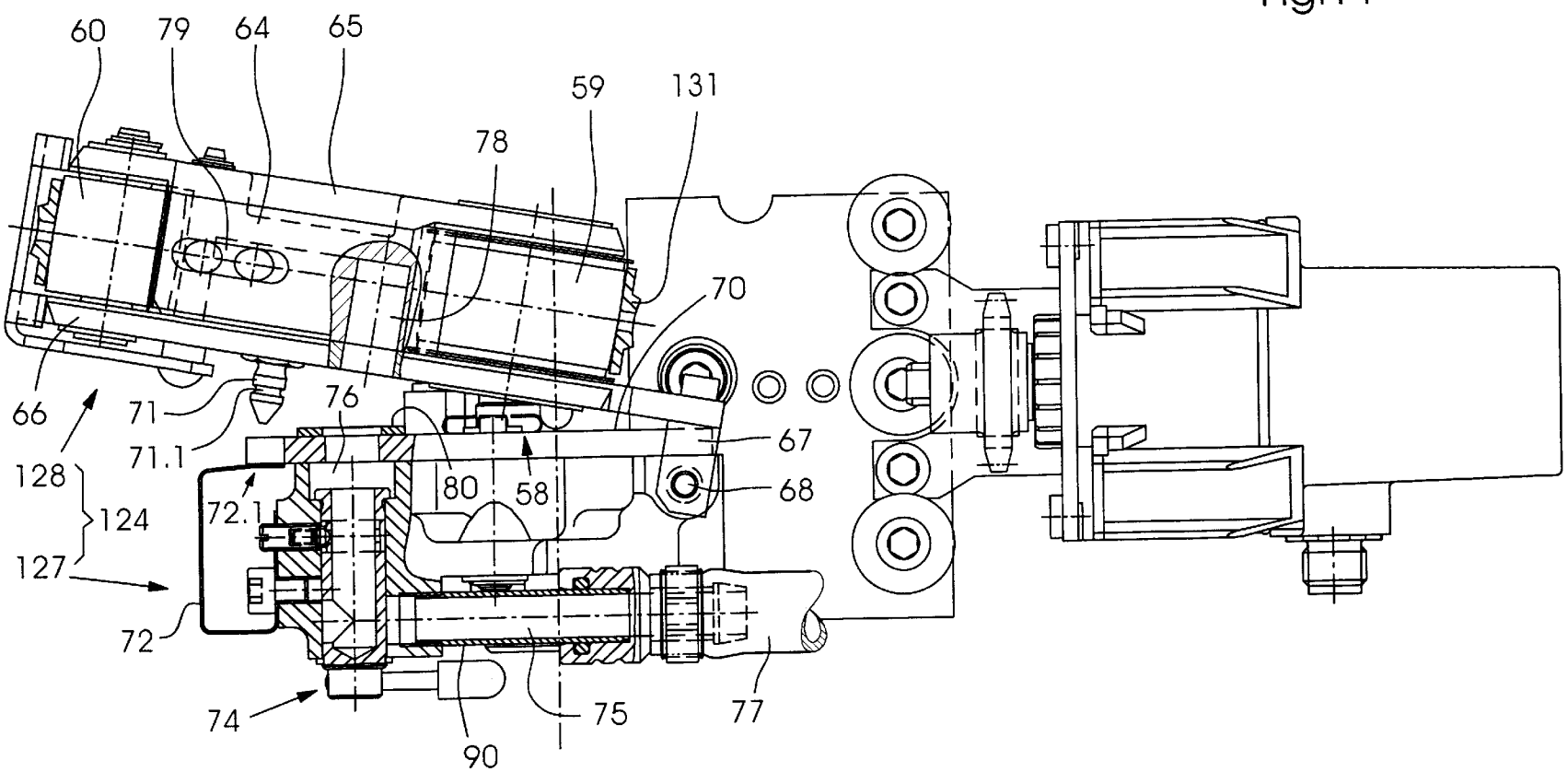
FIG. 11 is a plan view of a sheet brake according to the second embodiment.

In a refinement illustrated in FIGS. 9 to 11 of the aforementioned second embodiment, a gear mechanism 153 provided there in order to produce an operative connection which can be disengaged as mentioned between the braking element, present here in the form of a brake band 131, and the drive shaft 47 is integrated into a carrier module 127.

In a similar way to the carrier modules 27 of the first variant, a respective carrier module 127 is accommodated on a common guide and can be displaced along the latter. However, in the configurations of the second embodiment of the braking and supporting device, the common guide is not simultaneously part of the transport device for displacing a respective sheet brake 124 transversely with respect to the processing direction of the sheets 3, but, by way of example, is constructed in the form of a smooth guide tube 144, while a corresponding transport device, in the case of the second embodiment, comprises, by way of example, a roller chain 56 which is tensioned transversely with respect to the processing direction and a sprocket 57 which engages in the chain and which can be driven in alternating directions of rotation by a servomotor 51 flange-mounted on the carrier module 127.

As can be seen from FIG. 10, the gear mechanism 153 has, by way of example, an output gear 61, an intermediate gear 62 and a drive gear 63, which is constructed as an internal gear and to make a formlocking and axially displaceable connection to the common drive shaft 47, which is not illustrated here.

The coupling 58 mentioned hereinbefore for the releasable operative connection of the drive shaft 47 to the braking element, here in the form of the brake band 131, is preferably arranged between the output gear 61 of the gear mechanism 153 and a drive roller 59 driving the braking element.

In an analogous way to the braking module 28 of the first embodiment, a braking module 128 of the second embodiment, shown in phantom d chain-dashed in FIG. 9, comprises a suction chamber 64, over which the brake band 131 likewise provided with suction openings 32 sweeps and which, in the exemplary embodiment at hand, is fixed between two terminating plates 65 and 66, wherein the drive roller 59 and a deflection roller 60 are mounted, around which the brake band 131 is looped.

As can be seen in particular in FIGS. 10 and 11, the braking module 128 can be fixed to the carrier module 127 by a lockable plug-in connection and, at the same time, the drive roller 59 can be connected firmly, via the coupling 58, to the output gear 61 of the gear mechanism 153 so as to rotate therewith.

In order to implement the lockable plug-in connection, on the terminating plate 66, there is provided an attachment 67 which has a through hole. The latter is essentially perpendicular to the braking run of the brake band 131, which runs at the top in FIG. 9. Fixed to the carrier module 127 is an index pin 68 which is perpendicular in the installed position thereof shown in FIG. 9, can be inserted in a sliding manner into the through hole in the attachment 67, to be specific until a stop face 69 on the carrier module 127 fixes a final position of the braking module which permits the drive roller 59 of the braking module 128 to be coupled to the output gear 61 of the gear mechanism 153.

Formed on the carrier module 127 is a vertical joint face 70 which, in the finally mounted state, i.e., after the drive roller 59 has been coupled to the output gear 61, is parallel to the terminating plate 66 of the braking module 128 in the installed position of the carrier module 127 and aligned in the processing direction. In order to produce the aforementioned plug-in connection, the braking module 128 is, as can be seen from FIG. 11, initially pivoted away with respect to this joint face 70 in relation to the index pin 68. By pivoting the braking module 128, which can be plugged onto the index pin 68, in the direction of the joint face 70, firstly, the pivoting connection is locked and, secondly, the drive roller 59 is coupled to the output gear 61.

In the example at hand, in order to lock the pivoting connection, firstly, on the braking module 128 there is provided a pin 71 which has a conical end, projects beyond the terminating plate 66 and has a peripheral groove 71.1 (note FIG. 11) and, secondly, there is provided a leaf spring 72 which is fixed to the carrier module 127, is bent over many times and has a keyhole-like aperture at a free end 72.1 of the leaf spring 72, so that, in an end phase of pivoting the braking module 128 from its position pivoted away from the joint face 70 in the direction of the joint face 70, the pin 71, while entering the aforementioned aperture in the leaf spring 72, initially adjusts the free end 72.1 thereof transversely with respect to the pin 71, biasing the leaf spring 72, and then the peripheral groove 71.1 in the pin 71 latches in the manner of a bayonet closure into the aperture in the leaf spring 72, which springs back under the prestress, the free end 72.1 of the leaf spring 72 being supported on the carrier module 127 against giving way in the direction of the braking module 128.

The coupling mentioned hereinbefore is constructed as a claw coupling, and it has axially sprung claws 58.1. As can be seen in particular in FIGS. 10 and 11, for this purpose, in the example at hand, a leaf spring is arranged to be fixed against relative rotation on an end of the output gear 61, facing the joint face 70. The ends of the leaf spring are bent over away from the output gear 61 through 180°, in a mounted state, wherein the braking module 128 is plugged onto the carrier module 127 and the pin 71 is latched into the carrier module 127, bridge a clearance between the output gear 61 and an end of the drive roller 59 facing the latter, and engage in a corresponding rotary position in end recesses in a shaft 73 which belongs to the braking module 128 and is firmly fixed to the drive roller 59 so as to rotate therewith. If the aforementioned rotary position is not achieved, the leaf spring then bears, in the sprung state, on the end of the shaft 73 provided with the recesses and springs into the recesses during a subsequent rotation of the output gear 61, so that, in order to produce a rotational connection between the drive roller 59 and the output gear 61, they do not need to assume a mutual rotational position.

In the carrier module 127 which, in a completed state of a sheet brake 124, carries the braking module 128, there are provided suction ducts 75 and 76 which can be closed with respect to one another via a rotary valve 74 and of which the suction duct 75 can be connected via a suction line 77 to the vacuum generator mentioned hereinbefore, and the suction duct 76 opens into the joint face 70. In the completed state, a further suction duct 78 which is provided in the braking module 128 and arranged to be aligned with the suction duct 76 communicates with the latter and, ultimately, produces a fluid connection between the vacuum generator and the interior of the suction chamber 64 and a suction opening 79 communicating with the latter in a suction chamber 64 over which the braking run of the brake band 131 sweeps. In this case, the suction duct 78 of the braking module 128 is connected to the suction duct 76 via a sealing ring 80 provided between the joint face 70 and the braking module 128.

To this extent, when the braking module 128 is replaced by a supporting module, the fluid connection between the braking module 128 and the vacuum generator can be disengaged in a particularly simple way without any leakage, to be specific by simply closing the suction duct 75 by the rotary valve 74 and removing the braking module 128 from the carrier module 127.

Figure 15:
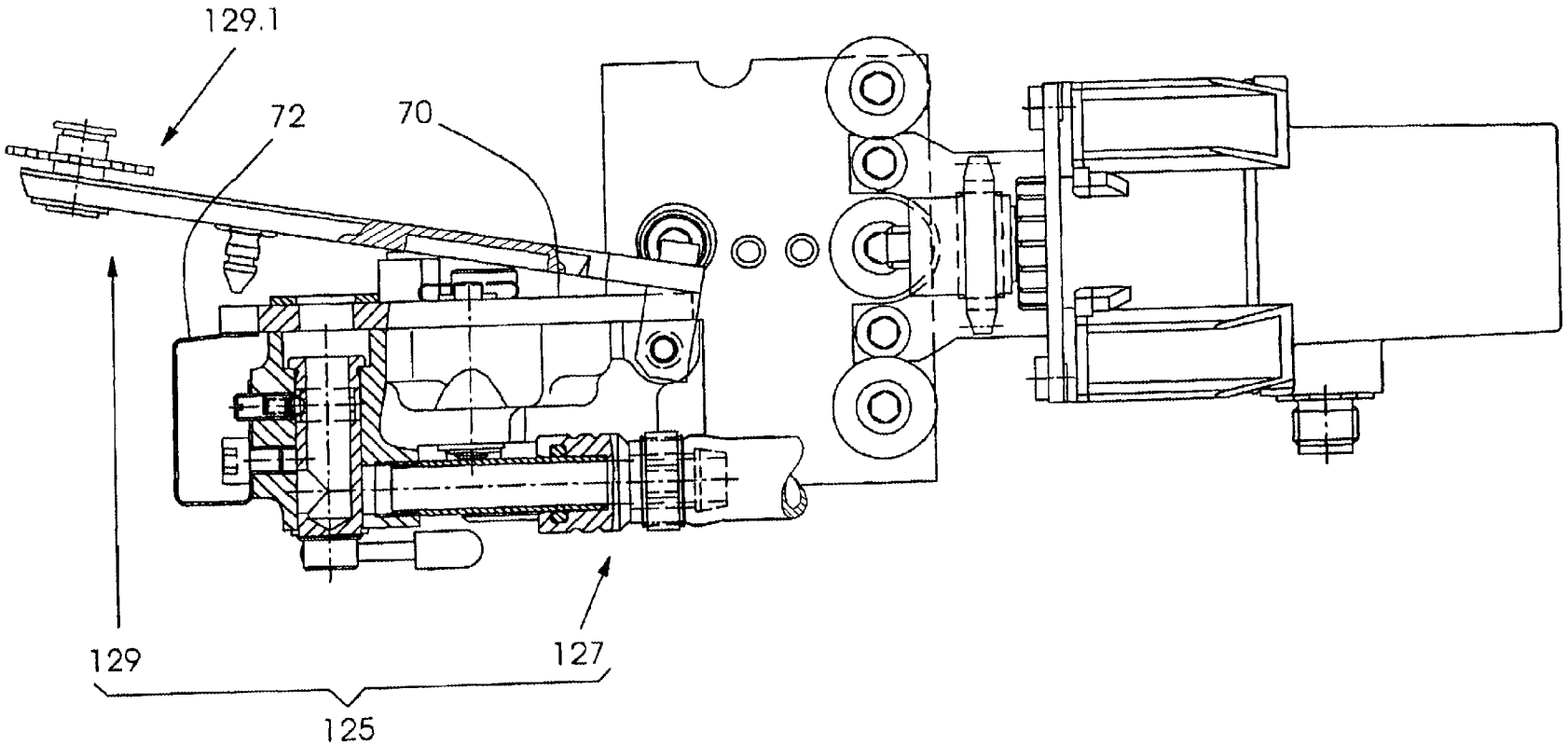
FIG. 15 is a plan view of a sheet support according to the second embodiment.

A supporting module 129 which can be connected to the carrier modules 127 instead of the braking module 128, or to a carrier module 227 which will be explained further hereinbelow, can be seen in FIG. 15 and is illustrated there by way of example in the form of a mechanical configuration with a tail wheel device 129.1. Together with the carrier module 127, the supporting module 129 therefore forms a mechanical sheet support 125 and is analogous to that constructed as disclosed in conjunction with the first embodiment of the braking and supporting device 11, and differs from the latter by a configuration with the effect that, by a plug-in connection provided for the braking module 128, it can be connected to the carrier module 127 or 227 in a manner similar thereto, can be pivoted against the joint face 70 and locked by the leaf spring 72. A face of the supporting module 129 which may rest on the joint face 70 is cut out in the area of the coupling 58.

Figure 12:
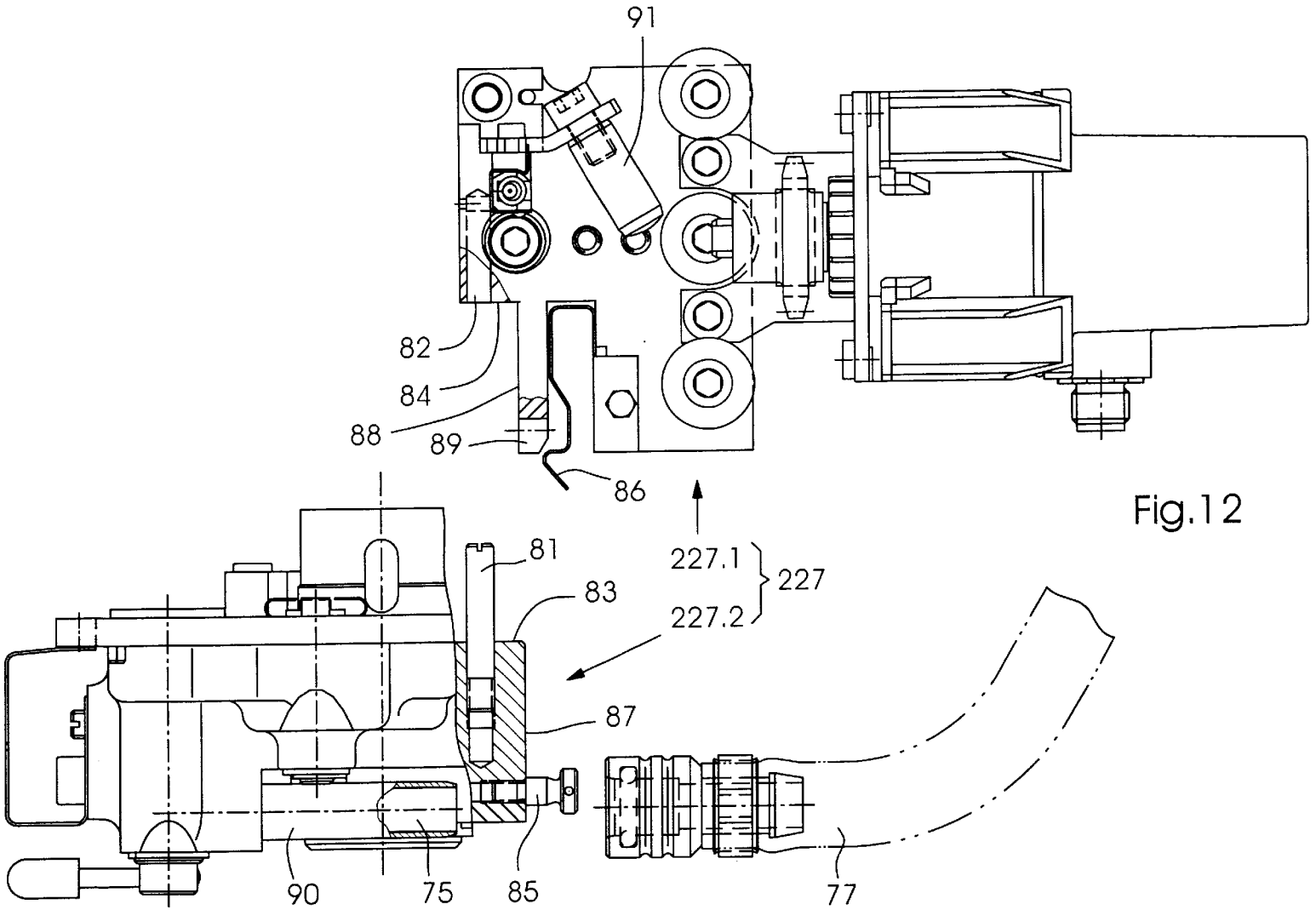
FIG. 12 is an exploded plan view of a carrier module of the second embodiment, which is assemblable from a basic module and a gear mechanism module.
Figure 13:
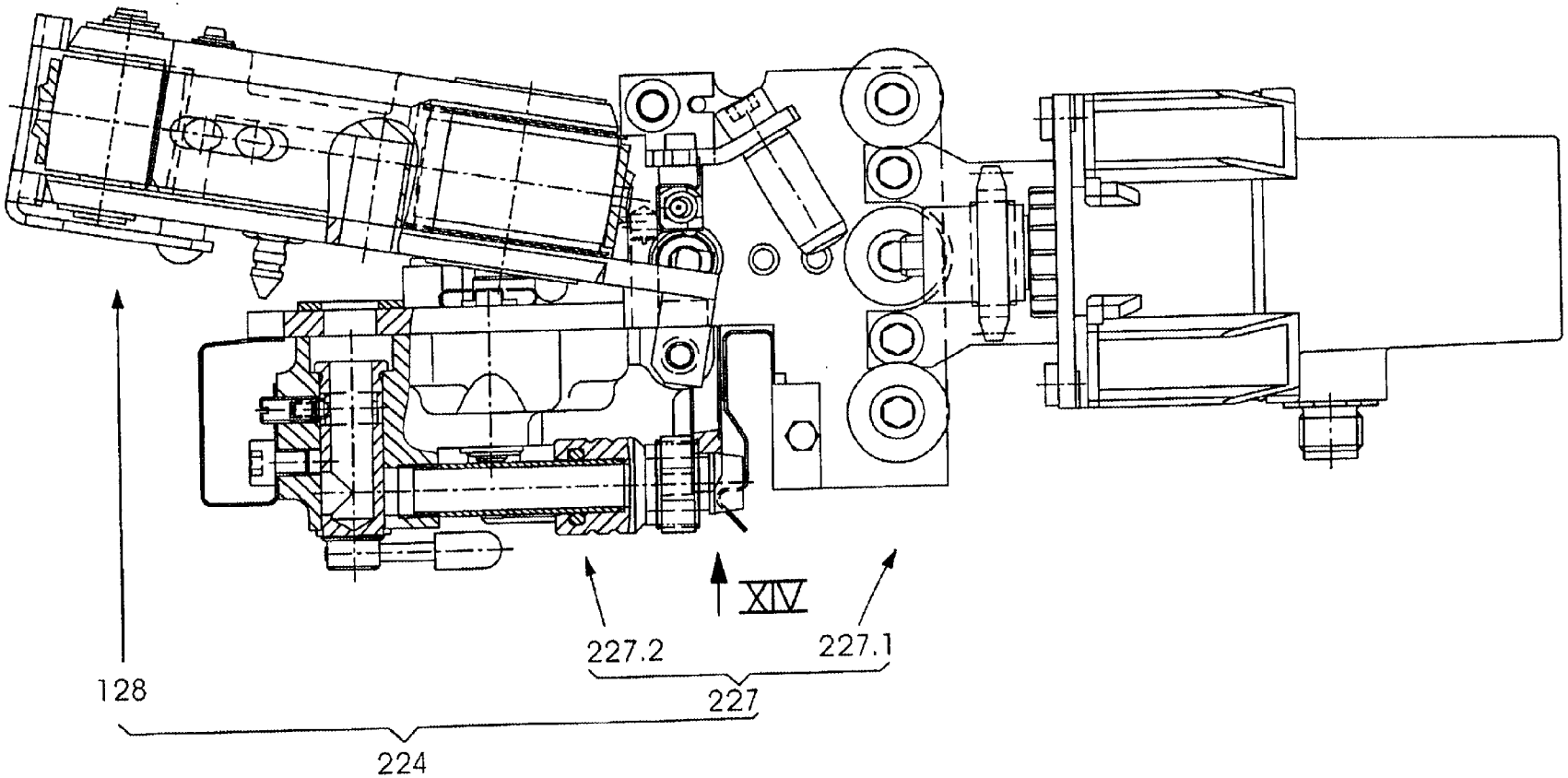
FIG. 13 is a plan view of the modules illustrated in FIG. 12 when they are joined together and supplemented by the braking module.

While in the configuration of the second embodiment of the braking and supporting device 11 which has been discussed to this extent, the gear mechanism 153 and the mutually closable suction ducts 75 and 76 are arranged in the carrier module 127, in a further configuration according to FIGS. 12 and 13, a separate gear mechanism module 227.2 is provided which is carried by a basic module 227.1 and again can be connected to the latter via a detachable and lockable plug-in connection, which, by way of example, is equipped with the gear mechanism 153 and the mutually closeable suction ducts 75 and 76 and with which a supporting module or the braking module 128 can be connected in the same way as in the configuration previously discussed, to be specific with regard to the plug-in connection by a pin corresponding to the index pin 68 (see FIGS. 9 and 11) with regard to the locking of the plug-in connection by a spring corresponding to the leaf spring 72 and, in the case of the braking module 128, also with regard to the connection between the drive roller 59 and a gear corresponding to the output gear 61 by a coupling corresponding to the coupling 58, and to connecting the suction chamber 64 to a suction duct corresponding to the suction duct 76.

With regard to moving a sheet brake 224 (note FIG. 14) according to this configuration and composed of the basic module 227.1, the gear mechanism module 227.2 and the braking module 128, along the common guide, in the configuration at hand along the guide tube 144, the basic module 227.1 is constructed by way of example in an analogous way to the construction of the carrier module 127 already discussed in this regard.

The detachable and lockable plug-in connection between the basic module 227.1 and the gear mechanism module 227.2 is configured so that the gear mechanism module 227.2 can be coupled to the basic module 227.1 in a direction which is parallel to the aforementioned guide tube 144 and therefore to the common drive shaft 47.

Figure 14:
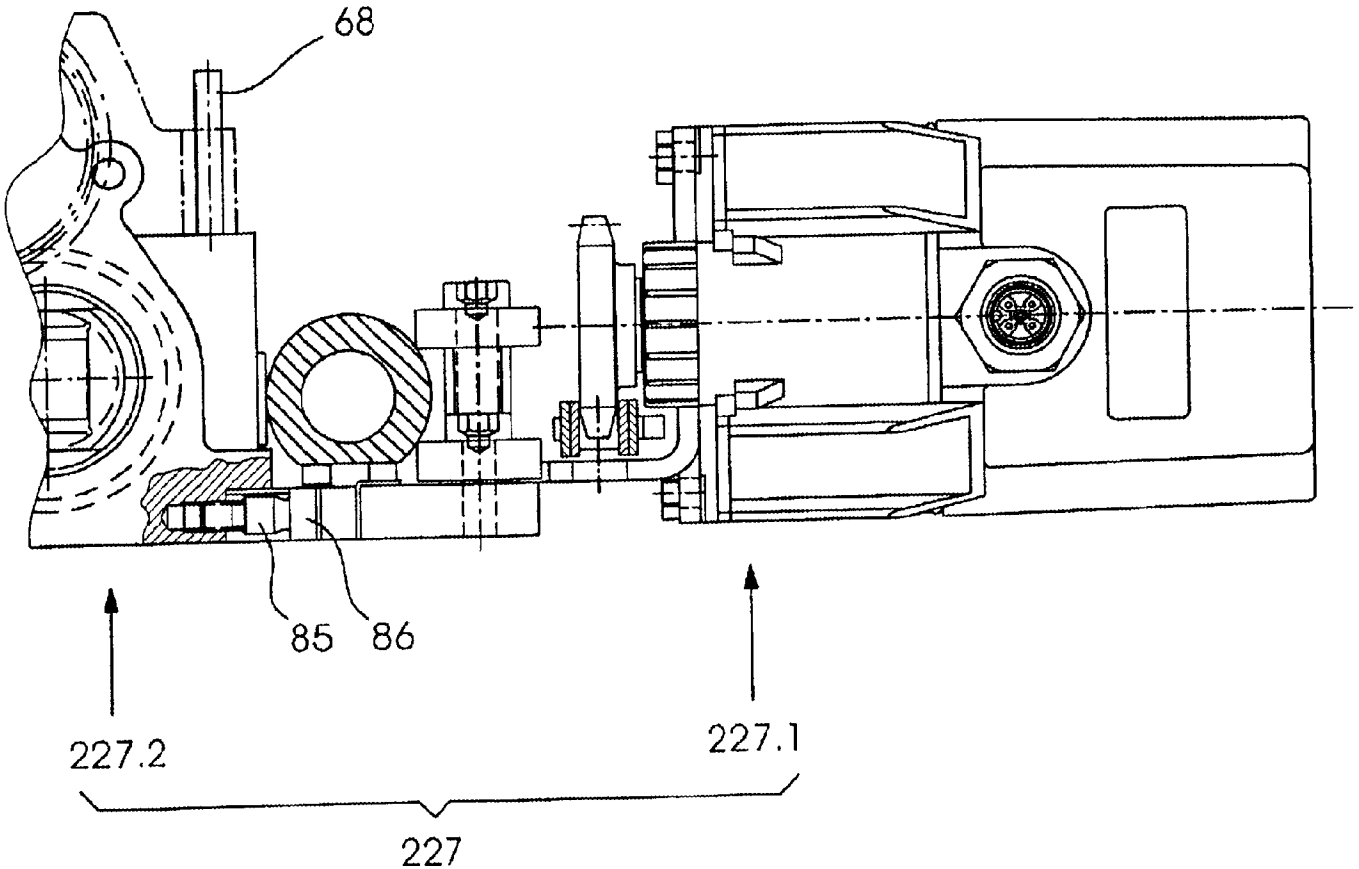
FIG. 14 is a fragmentary view of FIG. 13 as seen in the direction of the arrow XIV.

As can be seen from the plan view, reproduced in an exploded illustration in FIG. 12, of the carrier module 227 in conjunction with the plan view of the completed carrier module 227 according to FIG. 13 and the partial view according to FIG. 14, for this purpose there is fixed to the gear mechanism module 227.2 an index pin 81 which, in the installed position of the module 227.2 is parallel to the common drive shaft 47, and therefore also to the common guide (here in the form of the guide tube 144), and, in the basic module 227.1, there is provided a hole 82 which corresponds with the index pin 81 and is likewise parallel to the drive shaft 47 in the installed position. The index pin 81 can be inserted into the hole 82 until it rests mutually on mutually facing stop faces 83 and 84 of the gear mechanism module 227.2 and basic module 227.1. In this position, a sprung pawl 86 fixed to the basic module 227.1 and co-operating with a latching pin 85 provided on the gear mechanism module 227.2 prevents the index pin 81 from being withdrawn from the hole 82, so that the plug-in connection can be locked. A tilting movement of the gear mechanism module 227.2 around the index pin 81 is prevented by joint faces 87 and 88 on the gear mechanism module 227.2 and on the basic module 227.1, the faces being opposite one another in the aforementioned position. In addition, in the aforementioned position, the latching pin 85 engages with a formlock in a recess 89 which passes through the joint face 88.

In the configurations of the second embodiment of the braking and supporting device 11, the suction chamber 64 of the braking module 128 is connected to a vacuum generator, as mentioned hereinbefore, by the suction line 77. The latter can be plugged onto a nozzle forming the suction duct 75 on the carrier module 127 or the gear mechanism module 227.2.

FIG. 13 illustrates a sheet brake 224 which has been put together from the basic module 227.1, the gear mechanism module 227.2 and the braking module 128 to such an extent that, in a subsequent assembly step, the action of locking the braking module 128 on the gear mechanism module 227.2, and the associated production of a rotational connection between the output gear 61 of the gear mechanism 153 accommodated in the gear mechanism module 227.2 and the drive roller 59 of the braking module 128 can be performed.

The configuration of the sheet brake 224 or a sheet support conceived in this way and discussed to this extent, wherein the braking module 128 coupled to the gear mechanism module 227.2 is replaced by a supporting module 129 explained further above, can advantageously be dismantled under appropriate conditions down as far as the basic module 227.1, without requiring complicated actions on the braking and supporting device 11. For the purpose of such dismantling, the gear mechanism module 227.2 separated from the basic module 227.1 by detaching the plug-in connection can be stripped off the drive shaft 47 after one end of the latter has been exposed as explained hereinbefore.

In the preferred configuration at hand, the suction line 77 is detachably connected to the nozzle forming the suction duct 75 and, on the machine side, here on the side of the basic module 227 which remains in the machine during the aforementioned disassembly, a blind plug 91 is provided, onto which the suction line 77 pulled off the nozzle 90 in the course of the disassembly can be plugged. In this way, leakage is avoided particularly simply and advantageously even when the gear mechanism module 227.2 is disassembled.

We claim:

1. A delivery, comprising:

sheet brakes and sheet supports constructed of modules including respectively identical carrier modules and braking modules with operationally revolving braking surfaces;

support modules selectively connectable to said carrier modules for replacing said braking modules;

each of said braking modules having at least one roll and being selectively connected to a respective one of said carrier modules in a first operational mode; and each of said braking modules with at least one roll being detached from said respective carrier module in a second operational mode.

2. The delivery according to claim 1, including a guide common to said carrier modules.

3. The delivery according to claim 2, including servo-drives for moving said carrier modules along said guide.

4. The delivery according to claim 1, including a drive shaft common to said sheet brakes.

5. The delivery according to claim 4, including a latch bringable into and out of engagement with said drive shaft and, when engaged therewith, securing it against axial displacement, an end of said drive shaft being exposable when said latch is disengaged from said drive shaft.

6. The delivery according to claim 1, wherein said braking modules have operationally revolving braking elements and said braking surfaces are provided on said braking elements.

7. The delivery according to claim 6, wherein a respective sheet brake includes a gear mechanism for operatively connecting said braking elements to said drive shaft, said gear mechanism being constructed so that it can slide in longitudinal direction of said drive shaft.

8. The delivery according to claim 7, wherein said gear mechanism is integrated into said braking module.

9. The delivery according to claim 7, including a coupling for disengaging the operative connection between said drive shaft and said braking element.

10. The delivery according to claim 9, wherein said coupling is constructed as a claw coupling, and has axially sprung claws.

11. The delivery according to claim 9, wherein said gear mechanism is integrated into said carrier module.

12. The delivery according to claim 9, including a guide common to said carrier modules, one of said carrier modules being separably composed of a basic module movable along said common guide and a gear mechanism module comprising said gear mechanism, one module of said braking modules and said support modules being selectively detachably connectable to said gear mechanism module.

13. The delivery according to claim 1, including lockable plug-in connections for assembling respective modules for forming one of said sheet brakes and said sheet supports.

14. The delivery according to claim 1, including a first suction duct provided in said braking module, and a second suction duct provided in a module for carrying said braking module, said second suction duct being connectable to a suction line, and being closable, said second suction duct communicating with said first suction duct, in a completed state of said sheet brake.

15. The delivery according to claim 14, including a suction line detachably connected to said second suction duct and to a machine-side blind plug, to which said suction line is pluggable after the connection thereof to said second suction duct has been detached.

16. The delivery according to claim 1, wherein one of said support modules comprises a rowel.

17. The delivery according to claim 1, wherein at least one of said supporting modules serves for applying blast air locally to an underside of a respective sheet.

18. A sheet-processing machine having a delivery, comprising:

sheet brakes and sheet supports constructed of modules including respectively identical carrier modules and braking modules with operationally revolving braking surfaces;

support modules selectively connectable to said carrier modules for replacing said braking modules;

each of said braking modules having at least one roll and being selectively connected to a respective one of said carrier modules in a first operational mode; and each of said braking modules with at least one roll being detached from said respective carrier module in a second operational mode.

19. A rotary printing machine having a delivery, comprising:

sheet brakes and sheet supports constructed of modules including respectively identical carrier modules and braking modules with operationally revolving braking surfaces;

support modules selectively connectable to said carrier modules for replacing said braking modules;

each of said braking modules having at least one roll and being selectively connected to a respective one of said carrier modules in a first operational mode; and each of said braking modules with at least one roll being detached from said respective carrier module in a second operational mode.

20. A delivery, comprising:

sheet brakes and sheet supports constructed of modules including respectively identical carrier modules and braking modules with operationally revolving braking elements, said braking modules being selectively connectable to said carrier modules, and support modules selectively connectable to said carrier modules;

said braking modules having a first suction duct provided therein;

said carrier modules having a second suction duct provided therein; and a suction line connected to said second suction duct, said second suction duct being closable and communicating with said first suction duct, in a completed state of said sheet brakes.

21. The delivery according to claim 20, including a suction line detachably connected to said suction duct and to a machine-side blind plug, to which said suction line is pluggable after the connection thereof to said suction duct has been detached.

22. A delivery, comprising:

sheet brakes, a drive shaft common to said sheet brakes and a latch, said latch being provided for moving into and out of engagement with said drive shaft, said latch securing said shaft against axial displacement when engaged, and exposing an end of said drive shaft when disengaged; and sheet supports constructed of modules including respectively identical carrier modules and braking modules with operationally revolving braking elements, said braking modules being selectively connectable to said carrier modules, and support modules selectively connectable to said carrier modules.

23. A delivery, comprising sheet brakes and sheet supports constructed of modules including respectively identical carrier modules and braking modules with operationally revolving braking elements, said braking modules being selectively connectable to said carrier modules, and support modules selectively connectable to said carrier modules, and at least one of said supporting modules applying blast air locally to an underside of a respective sheet.

24. A method of operating a delivery in different operational modes for delivering printing sheets, the method which comprises:

providing carrier modules, support modules, and braking modules having rolls;

braking the printing sheets with the braking modules in a first operational mode;

changing the delivery from the first operational mode to a second operational mode, wherein the printing sheet is supported with the support modules, by detaching the braking modules with the rolls from the carrier modules and connecting the support modules to the carrier modules; and returning the delivery from the second operational mode to the first operational mode by detaching the support modules from the carrier modules and connecting brake modules with the rolls to the carrier modules.

* * * * *

UNITED STATES PATENT AND TRADEMARK OFFICE

CERTIFICATE OF CORRECTION

PATENT NO. : 6,871,849 B2
DATED : March 29, 2005
INVENTOR(S) : Sven Kerpe et al.

It is certified that error appears in the above-identified patent and that said Letters Patent is hereby corrected as shown below:

Title page,
Item [73], Assignee, should read as follows:
-- Heidelberger Druckmaschinen AG, Heidelberg (DE) --

Signed and Sealed this

Twenty-sixth Day of July, 2005

JON W. DUDAS
*Director of the United States Patent and Trademark Office*